United States Patent [19]

Frederick et al.

[11] Patent Number: 5,050,942

[45] Date of Patent: Sep. 24, 1991

[54] FILE INTERLOCK SYSTEM

[75] Inventors: Martin Frederick, New York City; Michael Glater; Steven Mavrakis, both of Brooklyn, all of N.Y.

[73] Assignee: Supreme Equipment and Systems Corp., Brooklyn, N.Y.

[21] Appl. No.: 305,452

[22] Filed: Feb. 1, 1989

Related U.S. Application Data

[63] Continuation-in-part of Ser. No. 84,307, Aug. 11, 1987, abandoned.

[51] Int. Cl.[5] ..... E05C 65/46

[52] U.S. Cl. ..... 312/221

[58] Field of Search ..... 312/216, 217, 218, 219, 312/220, 221

[56] References Cited

U.S. PATENT DOCUMENTS

| | | | |
|---|---|---|---|
| 3,969,008 | 7/1976 | Pergler | 312/221 |
| 4,298,236 | 11/1981 | Laroche | 312/221 X |
| 4,355,851 | 10/1982 | Slusser | 312/221 X |
| 4,429,930 | 2/1984 | Blouin | 312/221 X |
| 4,441,767 | 4/1984 | Stark | 312/221 X |
| 4,447,098 | 5/1984 | Parker | 312/221 X |
| 4,480,883 | 11/1984 | Young | 312/220 |
| 4,637,667 | 1/1987 | Reid et al. | 312/221 X |
| 4,662,689 | 5/1987 | Chatterson | 312/221 X |
| 4,711,505 | 12/1987 | Lakso | 312/221 X |
| 4,768,844 | 9/1988 | Ludwig | 312/221 |

FOREIGN PATENT DOCUMENTS

| | | | |
|---|---|---|---|
| 2740816 | 3/1979 | Fed. Rep. of Germany | 312/221 |
| 3431386 | 3/1986 | Fed. Rep. of Germany | 312/221 |
| 2514236 | 4/1983 | France | 312/216 |
| 7604359 | 10/1977 | Netherlands | 312/340 |

*Primary Examiner*—Joseph Falk

*Attorney, Agent, or Firm*—Lieberman, Rudolph & Nowak

[57] ABSTRACT

An interlock system for use in an array of retractable storage cradles. The instant system prevents the opening of more than one cradle at one time through a slide modified generally by a biased cam insertion-extraction means and a column of movable components. The system can be used in free-standing file cabinets as well as prefabricated and modular storage units.

5 Claims, 3 Drawing Sheets

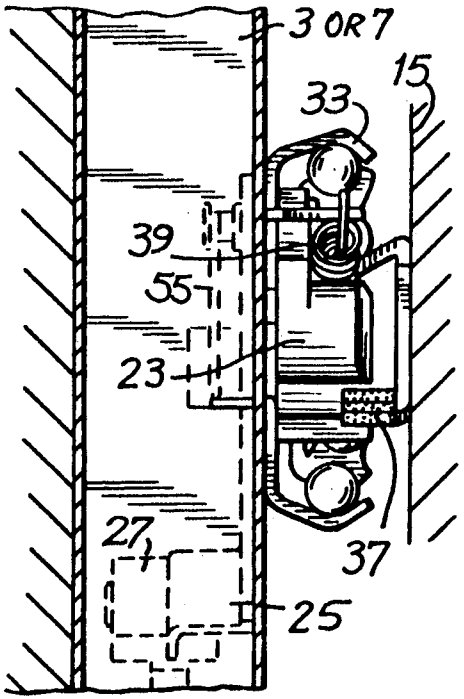
FIG. 3
FIG. 2
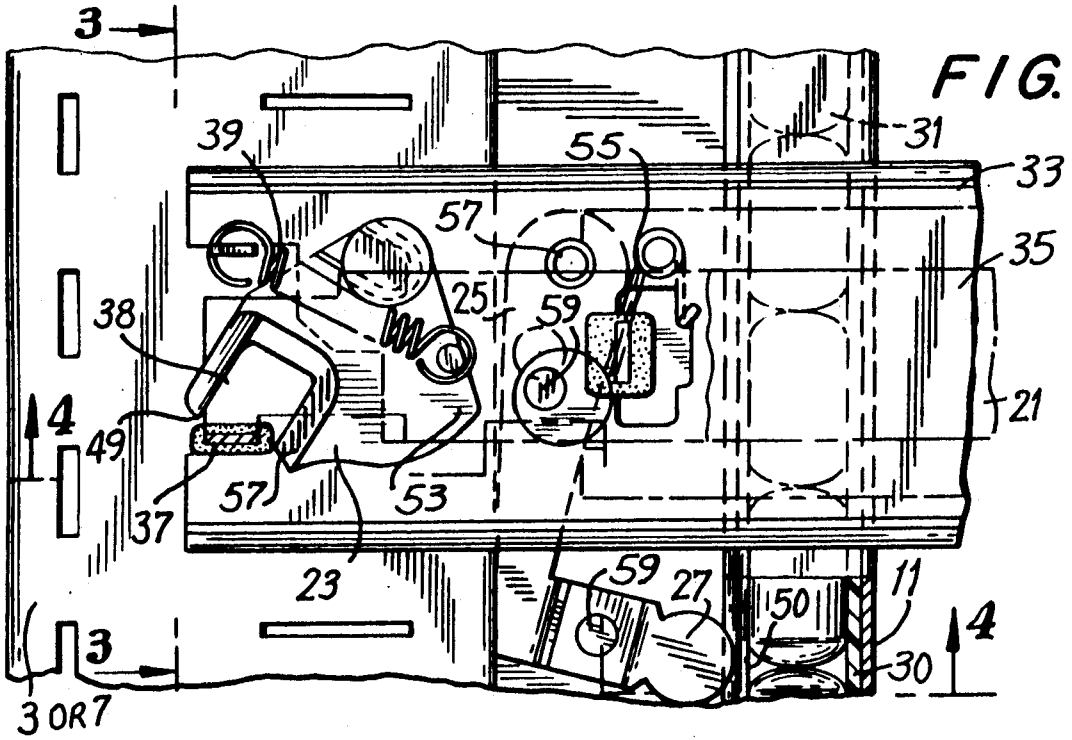
FIG. 4
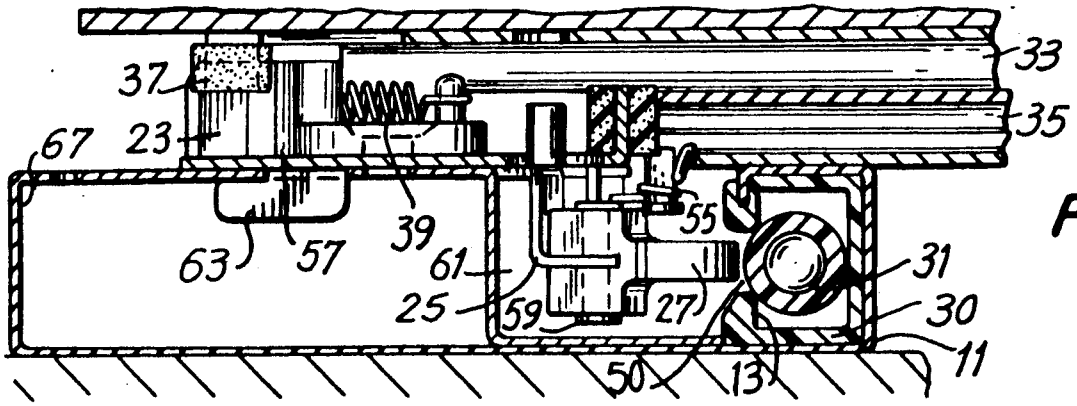

FILE INTERLOCK SYSTEM

This application is a continuation-in-part of U.S. Ser. No. 084,307, filed Aug. 11, 1987, now abandoned.

FIELD OF THE INVENTION

The instant invention relates generally to an interlock system for use in an array of vertically stacked storage elements or cradles designed to prevent the opening of more than one storage element at any one time. If more than one element is opened at any one time, the array can become unstable and tip, causing injury. Thus, the incorporation of an interlock system is necessary to insure the safety of employees and users of vertically disposed storage elements.

DESCRIPTION OF THE PRIOR ART

File interlock systems are necessary, and in some situations required by law, in order to protect personnel from the potential "tipping" hazard created if more than one storage element of a vertical array of file drawers is opened at one time. The prior art describes many types of interlocks for use in office cabinets. These interlock devices all depend on various complex combinations of sliding bars, springs, cables and cams, and the majority are either too cumbersome and complicated, or too easily overcome.

For example, U.S. Pat. No. 3,378,321 for "Filing Cabinets", relates to a filing cabinet having a series of laterally stacked drawers, each attached to each other by a cable. Tension on this continuous cable prevents more than one drawer from being withdrawn from the cabinet at any one time. However, the cable may be cut by an overanxious user.

U.S. Pat. No. 3,870,387, for a "File Drawer Interlock Mechanism", describes a mechanism in which a channel is mounted on each drawer and a series of corresponding rollers are mounted on a single sliding lock bar mounted within the cabinet. The lock bar is configured in such a manner that when one drawer is withdrawn the channel attached to that drawer engages a corresponding roller on the lock bar causing the lock bar to shift in position. In this shifted position none of the remaining channels can engage any of their respective rollers and therefore, opening of any of the remaining drawers is prevented. This type of interlock mechanism is one of several in the prior art which use a sliding lock bar mounted in a cabinet, which shifts in position when engaged by a cam or other mechanism mounted on an opened drawer. It is sometimes cumbersome, and not capable of being retrofit on an existing cabinet, in other words, it must be manufactured with the interlock in place.

U.S. Pat. No. 3,900,236 for a "File Interlock" describes a side mounted interlock for use in a filing cabinet in which a series of individual lock bars are used rather than one continuous lock bar. In addition, a rotating cam is used to maintain the lock bars in a blocking position when any one of the drawers is open. The multiple lock bar system has an advantage in preventing the defeat of the interlock by attempted forced opening of more than one drawer simultaneously. It, too, is cumbersome and generally incapable of a retrofit or modification.

U.S. Pat. No. 4,272,138 describes a "Cabinet Drawer Antitip Lock Device" which uses a series of multiple lock bars held in place by a fixed cam mounted to each drawer. This also suffers the aforementioned drawbacks.

The abstract of Netherlands Patent No. 7,604,359, shows a series of lugs that swing levers into recesses in a set of similar components, to provide an interlock. This, too, suffers the drawbacks.

U.S. Pat. No. 4,711,505 to Lakso discloses a line of balls contained in a channel and compressed via springs 39 at either end of the channel. Each drawer is provided with an actuator and a ball 36. The actuator is essentially a metal plate that possesses a chamfered recess 38 in which at least a portion of the ball resides in the unlocked position. As actuator 38 swings (that is a drawer is opened), the ball 36 is forced out of the recess 38 against the metal plate of the actuator, on one side, and against but not into the line of balls on the other, locking, in theory, the line in place and barring insertion of any additional ball 36, and thus no other drawers may open. However, the Lakso device will not function if the ball 36 enter the line of balls fully, because there is no extraction mechanism for removing the ball from the line. It is contemplated that the Lakso device will suffer from periodic jamming to the extent that the ball 36 becompes trapped by the bias effect of the line of balls. This complicated device also suffers from the same drawbacks generally mentioned above.

U.S. Pat. No. 4,447,098 to Parker deals with a manually moveable series of blocking elements 36 which, in order to be operated, must be manipulated by the user before attemps can be made to open a drawer. The blocking elements in Parker are also placed upon a guide 38 as an additional manufacturing step rather than being place in an already existing support member. Thus, though this manually assisted device is simple, it is inaccurate, as it is dependent upon the user to set up, and is also incapable of a retrofit. Generally, an interlock must also be invisible and inaccessible to the user to prevent the user from removing it. Parker also fails in this regard.

The instant invention resides in changes to the slidable mounting means ("slide"). The slide is retractable, and is mounted on the storage elements and support structure of the cabinet (columns, etc.). Prior art slides are known and commonly used in file cabinets to support and provide the articulation for lateral file drawers. Such devices are manufactured by companies such as Thomas Regout NV, the Netherlands. Each slide features a movable slide section or sections upon which a storage element is mounted and a stationary slide section which is affixed to a supporting wall or post of the cabinet or array structure. The movable slide section features a detent cam mechanism which is used to hold the drawer in a closed position until force is applied to open it, thereby preventing the drawer from opening by itself due to vibration or imperfect placement.

All of the interlock devices known to applicants are cabinet-based and feature complex structures which must be installed as part of the cabinet at the time the cabinet is manufactured. None of these devices is designed to be retrofitted into an existing cabinet or prefabricated shelving system, or is invisible and innaccessible to the user, or is failsafe and accurate.

Therefore, it is one object of the present invention to provide an interlock system for use with an array of retractable storage elements which prevents more than one element from being open at any one time.

It is a further object of the present invention to provide an interlock system which can be installed in an existing cabinet or prefabricated structure.

It is yet a further object of the present invention to provide an interlock system that is relatively invisible and inaccessible to the user.

It is still a further object of the present invention to provide an interlock system for use in an array which is self-aligning and accurate for repeated use.

SUMMARY OF THE INVENTION

The instant invention replaces the sliding lock bar, multiple lock bar and cable systems known in the prior art with an interlock system utilizing a substantially filled member placed within one or more walls or columns of a cabinet or prefabricated vertical array of retractable storage elements.

These storage elements are generally comprised of cradles each of which can, with the addition of a front face, act as a drawer, or alternatively form a base for a file shelf. As used herinafter "cradles" include drawers, shelves, platforms and the like.

File cabinets are designed basically to comprise two side walls and optionally a rear wall. File cabinets can be constructed using column supports, and a rear support. It is to be understood that the particular design of the file cabinet superstructure or skeletal structure is not critical to the invention, and any known design can be made to accomodate the instant interlock.

Cradles are retractably mounted within a cabinet on telescoping slides. Such slides are shown herein to also function as structural support members, attaching horizontally to vertical columns. Similarly the cradles of a prefabricated array can be slide-mounted to other support members of the array.

In the instant invention, the prior art telescoping slide is modified by installing an insertion-extraction cam and insertion plunger along a portion of the stationary section of the slide and in contact with the detent cam of the slide. Also, each side wall of a cabinet, or vertical support member (column) of a prefabricated array, is fitted with a vertical slide trough with a retaining lip. This trough is substantially filled with blocking members, held in position by the lip. Each blocking member is generally tubular, cylindrical or spherical, and can be fabricated in many shapes, and of extruded plastic or other rigid or semi-rigid materials.

In one embodiment of the invention, the partially filled blocking member comprises a channel containing a plurality of slidable components which can move relatively freely within the available space of the channel. Each of these slidable components is shown equal diameter or dimension, though the dimensions are not critical and even differently components will work. The channel contains a number of components such that an unfilled portion of the channel (void) is created of special vertical dimension (height).

When a cradle is opened, the detent cam of the stationary section of the slide is forced to rotate by an engaging tab attached to the movable section of the slide means which is attached to the cradle. The detent cam possesses a cam on its forward face which, simultaneously with the opening of a cradle, engages a pivoting armiture which urges its insertion head portion into the channel or trough substantially filling the void between the components, and causing the slidable components therein to shift position as necessary. The respective insertion heads associated with the remaining closed cradles are thus blocked from entering the channel and therefore these cradles cannot be opened.

If an attempt is made to open two or more cradles simultaneously no drawers will open because the unfilled portion of the channel will allow the entry of only one insertion head at a time. Since the insertion head on other unopened cradle slides will not be able to enter the channel, the cam will not be able to turn and the detent cam section will remain stationary, confining the detent and disallowing the opening of the cradle. Once the open cradle's slide is closed, the detent pushes its associated cam rearwards of the cabinet, and the cam on the forward face allows the spring loading armiture to ease rearward, as well, thereby extracting, by positive action, the insertion head from the channel. After extraction, any one cradle can next be opened and the operation of its interlock is repeated.

The instant interlock is designed so that the spacing between the storage elements can be irregular and adjustable when used in a prefabricated shelving system. This is because the number and spacing of the storage elements are not dependent on a matching number of blocking elements, e.g. lock bars.

It is, therefore, a feature of the present invention to provide an interlock which can be easily installed in a file cabinet or a prefabricated structure.

It is a still further feature of the invention to provide an interlocked vertical array of retractable storage elements which can be irregularly spaced.

It is yet a further feature of the invention to provide an easily installed insertion-extraction cam which is controlled by simple modification of the detent cam built into the drawer slide.

It is another feature of the invention that it can be used with a prefabricated filing structure built to meet design requirements specified by an architect or customer.

It is still a further feature of the invention to provide a self-aligning insertion head controlled by action of a positive action insertion-extraction mechanism.

These and other objects and features of the present invention will become more apparent when taken in conjunction with the following description and drawings, wherein like characters indicate like parts.

BRIEF DESCRIPTION OF THE DRAWINGS

FIG. 2 is side sectional view of a portion of FIG. 1, taken along line 2—2, and showing a cradle in the closed position.

FIG. 3 is a side plan view of FIG. 2, taken along line 3—3 thereof.

FIG. 4 is a bottom plan view of FIG. 2, taken along line 2—2 thereof.

DETAILED DESCRIPTION OF THE INVENTION

In order to prevent tipping, safety dictates that a prefabricated array of vertically stacked retractable cradles or a similarly designed cabinet be provided with means to prevent more than one cradle from being opened at any one time. An array of vertically stacked retractable cradles 1 comprising one embodiment of the instant invention is described in FIG. 1. The cradles are mounted to a plurality of prefabricated structural members by horizontally mounted slides, each supplied with a detent cam.

Figure 1:
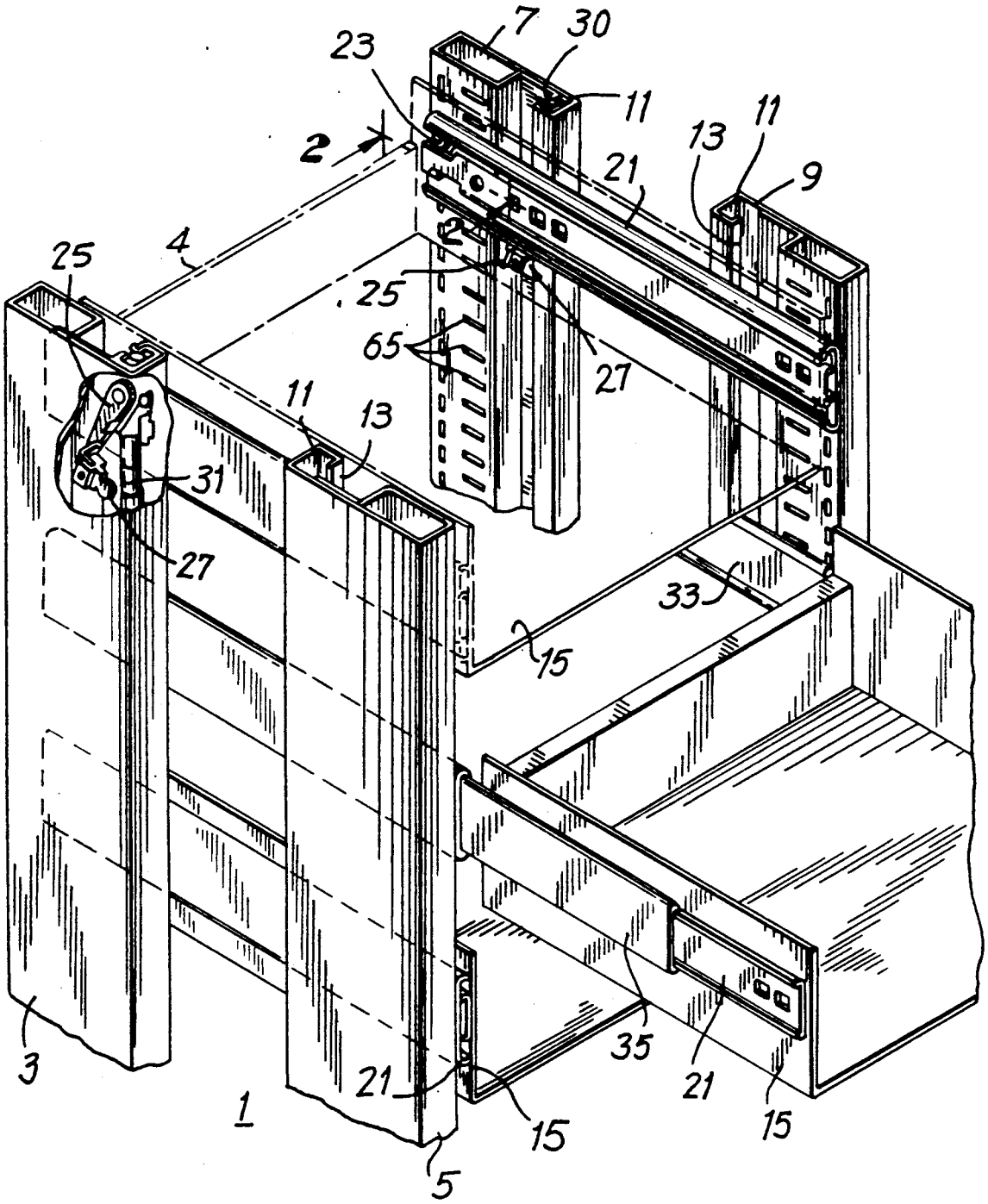
FIG. 1 is an isometric, partially sectional view of an array of vertically mounted retractable cradles incorporating one embodiment of the instant invention.

FIG. 1 describes four vertical, rectangularly disposed posts 3, 5, 7 and 9 which are designed to be fastened together by various horizontal members 4 and with other structural members (not shown) in order to form a prefabricated office shelving system or office dividing wall system 1. This type of prefabricated structure is designed to be constructed to the specification of the customer and the posts can support a variety of storage elements such as stationary or retractable cradles which in turn can support document files, recording files, shelves with adjustable dividers etc. Posts 3, 5, 7 and 9 are each formed with a trough 11 running along the longitudinal axis of each member, each trough having a retaining lip 13. Three retractable cradles 15 are each mounted on pairs of slides 21. Cradles can be configured to accomodate whatever elements are desired to be stored therein. Thus the cradle could be provided with a front face or door (to make a drawer, for example), though this is not shown for simplicity. Only one drawer is shown in FIG. 1, modified in accordance with the invention, but it is to be understood that the same modification is provided for each successive, lower cradel in the array 1, provided, as stated below, that the interlocks all align on the same column.

Slides 21 are designed to provide the slidable opening and closing of the cradles in order to allow access to the contents, each including a biased detent cam 23 which, among other things, retains retractable cradles in a closed position and provides interlock features in the open position, as explained further below. Only one slide per cradle need be modified in the instant invention, provided the interlocks are all aligned on the same column. FIG. 1 shows an interlock on both sides of the first cradle simply for ease of understanding the invention.

As part of the instant invention the slides 21 mounted to post 3 or 7, for example, are modified as follows. First, the cam is replaced with a new cam 23 having on its rearward face the standard detent cam for holding the cradle closed, and on its forward face a new cam for engaging the armiture 25 which pivots and inserts the insertion head 27 into the vertical trough 11.

Each of the columns 3, 5, 7 and 9 possesses a trough 11 which defines a channel 30. At least one of these channels is partially filled with a plurality of movable components 31 which are shown as generally having the same shape, though the shape, itself, is not critical to the invention. Channel 30 can be a plastic extrusion which is inserted into trough 11 and held in place by retaining lip 13.

The center cradle 15 is shown in the open position and its corresponding slides 21 are shown in the extended position showing stationary slide section 33 and movable slide sections 35 common to all of the slides 21.

FIG. 2 through 4 are detailed views of top cradle 15 in the closed position, showing an enlarged view of slide 21 comprising stationary slide section 33 and movable slide section 35, as well as armiture 25, insertion-extraction cam 23, post 3 or 7, trough 11, channel 30 and components 31. FIG. 2 is a partially sectional view from the inside of the structure 1 along line 2—2. Insertion-extraction cam 23 is shown held in the "closed" position by the tension of spring 39. Movable section 35 of slide 21 is retracted within stationary section 33 and engagement tab 37 of movable section 35 is held in place within slot or detent 38 of cam 23. Slot 38 is formed with two ridges 49 and 51 which are formed of walls perpendicular to the plane of the cam 23 (i.e., outwardly from the plane of the page) and which contact the tab 37. Cam 23, on its rearward face possesses detent 38 with walls 49 and 51. On its forward face, cam 23 is adapted with a protrusion (essentially another cam) 53 which in operation articulates armiture 25 by contacting a pin 57. Armiture 24 is attached to the back of stationary slide section 33 via pivot 57, and thus is shown in dotted form in FIG. 2. Pin 59 passes through slide section 33 and rides the contours of protrusion 53, in operation. Armiture 55 is biased by spring 55 such that it is forced rearward, away from the line of movable components 31.

Fitted on the lower section of armiture 25 is insertion head 27, swingably mounted by pivot pin 59 such that the head 27 can move 5 to 10 degrees from its center to provide alignment with the line of components 31, in operation, to ensure a precise fit.

As shown in FIG. 3, channel 30 is formed with an open face 50, resembling the letter "C" when viewed from the top. Components 31 are slidably stacked within the channel 30, and are held horizontally in place by the arms of channel 30. The insert of head 27 is in alignment with the opening of trough 11 and the open face 50 of channel 30.

FIG. 3 shows the invention along lines 3-3 of FIG. 2, in the closed position, and the various components identified above.

FIG. 4 is a cross-sectional view looking upward along line 4—4 of FIG. 2, showing the placement of the interlock device in a standard column 3 or 7 and slide 21. Between the trough 11 and rectangular wall 67 of the column 3 or 7 is a gap 61 which provides for the placement and movement of armiture 25. Tab 63 provides for the mounting of the modified slide within grooves 65 of the columns 3, 5, 7 and 9 (see FIGS. 2 and 1).

Figure 6:
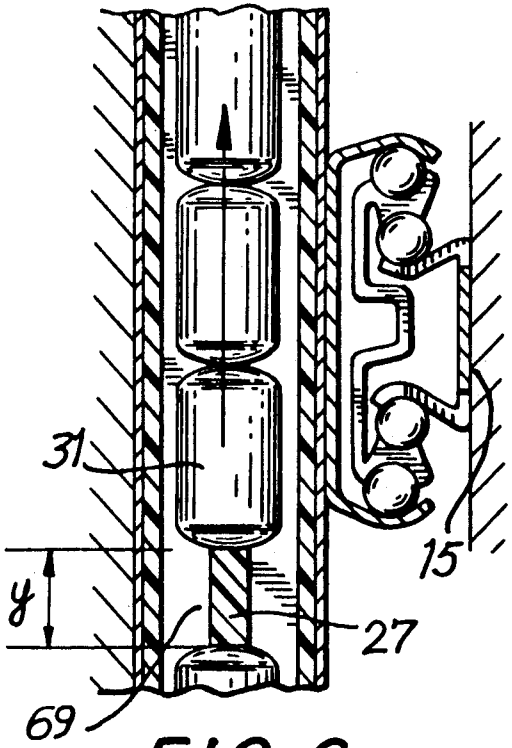
FIG. 6 is a side plan view of FIG. 5, taken along line 6—6 thereof.
Figure 5:
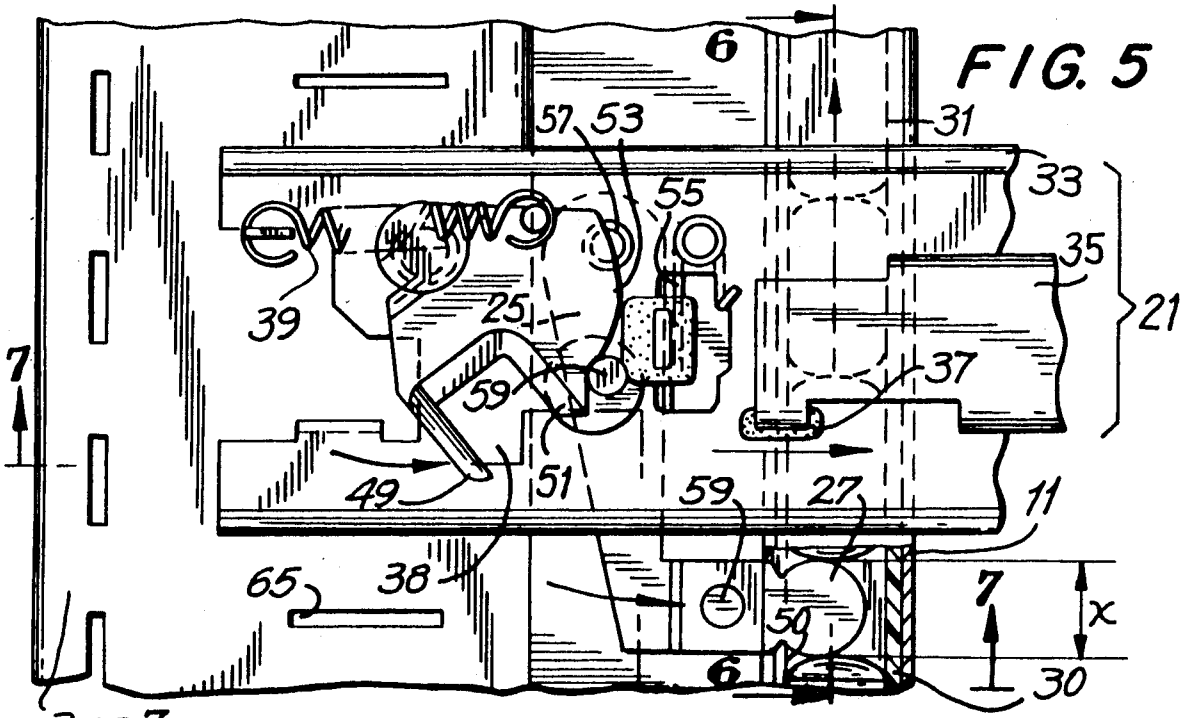
FIG. 5 is side sectional view of a portion of FIG. 1, taken along line 2—2 thereof, and showing a cradle in the open position.
Figure 7:
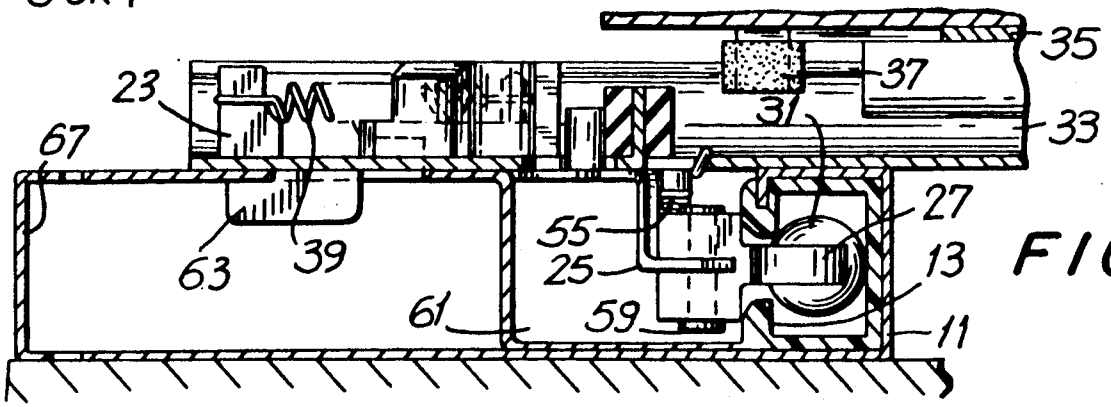
FIG. 7 is a bottom plan view of FIG. 5, taken along line 7—7 thereof.

FIGS. 5 through 7 depict the embodiment of the invention shown in FIGS. 2 through 4, with the cradle in the open position. When the cradle is withdrawn, the movable section 35 of slide 21 extends outwardly from stationary section 33. Movable section 35 supports the cradle in the open position as shown in FIG. 1. As movable section 35 is urged forward by the force applied to open the cradle, engagement tab 37 engages ridge 51 of detent cam 23 causing it to overcome the bias provided by the spring 39 and rotate to its "open" position. As this occurs, rearward cam 53 of cam 23 rides along pin 57 (which passes through stationary section 33 and attaches to armiture 25), causing armiture 25 to move forward in the same direction as movable section 35. As the bias caused by spring 55 is overcome by movement of cam 23, insertion head 27 is urged forward, and enters channel 30, displacing the components 31, and generally filling the remaining volume within the channel 30. Therefore, with any one cradle in the open position, insufficient room remains in the channel for the entry of another insertion head corresponding to another cradle. The result is that one and only one cradle can be opened at one time.

Critically, we have identified the maximum void or vertical space 69, as shown in FIG. 6, to be at least as large as the vertical height of the insertion head 27, but less twice its height, in order for the interlock to be effective. In other words, with respect to dimension (x), as shown in FIG. 5, and dimension (y) as shown in FIG. 6:

$$x \leqq y < 2x$$

If y becomes larger than 2x, it is possible that more than one drawer can be opened at one time, since two insertion heads 27 of height x can thereby be inserted. Thus, these dimension become very critical.

It can also be seen that the precise shapes of the components 31 are less critical than the size of the void 69. Even variously different shaped components 31 can be used without impeding the operation of the system, provided these components can be fitted into trough 11 and channel 30, and provided they allow some tapering for insertion of head 27.

Spring 39 is attached to the detent cam 23 in such a manner as to exert retaining tension on the detent cam 23 in both its "open" and "closed" position. This tension tends to retain the cam in whichever position it is in. In its "open" position, the curved orientation and stop of the forward cam 53 against the pin 57 tends to hold the slide and drawer in an open position, as the forces acting thereon tend to balance one another, until the user urges the drawer closed, at which time, the pin rides the contours off cam 53, and the cooperative spring biases 39 and 55 assist in providing positive action for extraction of the head, simultaneously bringing the slide to a closed position. Thus it can be seen that the bias created by the components 31 do not affect the operation of the insertion-extraction, as the insertion head 27 is inserted beyond the point where the bias has any effect, and is extracted by action of the bias of the spring.

In operation, when cradle 15 is returned to the closed position, the engaging tab 37 of movable member 35 engages ridge 49 of detent cam 23 urging it to rotate against the tension of spring 39 and into its "closed" position once again. In its "closed" position, detent cam 23 tends to lose contact with pin 57, and thus spring 55 holds the armiture 25 in place, preventing insertion into the channel.

In terms of construction, components 31 should be shaped to allow efficient intergration with and separation by the plunger cam insert and ease of movement within the channel, and should be hard but not brittle and can be made of metal, plastic, hard rubber, wood, ceramic, or other resilient materials. The posts and other structural members are properly constructed of steel or sheet metal and the channel can be a plastic extrusion or suitable molded or cast material. The armiture can be made of plastic, steel or other suitable material, although steel is preferred to prevent breakage by tugging. The insertion head can be of hard plastic, matching the construction of components 31.

In a prefabricated array of shelves, the instant invention allows the cradles to be spaced at irregular intervals within the limits of cradle size and the mounting constraints of the slide mounts, by placement of grooves 65 at increments along the columns (see, e.g., FIG. 1), into which tabs 63 may be inserted (see, e.g. FIGS. 4 and 7). In addition, the instant interlock system permits an array of stationary prefabricated shelves to be converted at a later date to an array of retractable cradles by inserting a prefabricated channel with slidable components e.g. spheres or cylinders or the like, into at least one of the support posts (which must already have the trough formed within it) and mounting the cradles upon slides as modified by the instant invention described above. This retrofit is easy, and effective.

A lock can also be provided by mounting a rotating or sliding cam on the post in which the channel in installed. The cam can be made to enter the channel when all of the cradles are closed, thereby taking up the remaining volume and preventing any of the cradles from being opened.

Although the embodiment described above, are shown mounted along only one side of the structure, it is to be understood that the embodiments described can be placed on both sides and work together to accomplish in reinforced fashion, the interlock effect of the instant invention. In addition, combinations of the embodiments can be used within one particular cabinet.

While the invention has been particularyly shown and described with reference to preferred embodiments thereof, it will be understood by those skilled in the art that the foregoing and other changes in form and details may be made therein without departing from the spirit and scope of the invention.

We claim:

1. An interlock mechanism for a multi-drawer filing cabinet utilizing a slide with a stationary and movable section and cradle drawer mounting means, the mechanism comprising:

a) a vertical channel attached to the filing cabinet and having a vertical space of fixed height;

b) a plurality of movable components disposed in the vertical space, the number and vertical dimensions of the movable components being such so as to create a void in the vertical space of a predetermined height;

c) an armature pivotably attached to the stationary slide section;

d) an insertion head fixedly attached to the armature and having a vertical dimension less than the predetermined height of the void and greater than one-half the predetermined height of the void; and e) insertion-extraction means so disposed in the filing cabinet that it is capable of engaging a drawer of the filing cabinet and the armature;

the vertical channel, armature, insertion head, and insertion-extraction means being so disposed with respect to one another that upon opening of a drawer of the filing cabinet, the insertion head is fully inserted into the vertical space of the channel and upon closing of the drawer the insertion head is extracted from the vertical space.

2. An interlock mechanism of claim 1, wherein the insertion-extraction means comprises a cam articulating against the armature and wherein the armature is spring biased.

3. An interlock mechanism of claim 1, wherein the components are semi-cylindrical and of uniform size.

4. An interlock mechanism of claim 1, wherein the components are made of plastic.

5. An interlock mechanism of claim 1, wherein the insertion head is self-aligning.

* * * * *